US009783921B2

(12) United States Patent
Wang et al.

(10) Patent No.: US 9,783,921 B2
(45) Date of Patent: Oct. 10, 2017

(54) DOSING DEVICE OVERCOMING CHANGE IN VISCIDITY OF DETERGENT AND METHOD FOR CONTROLLING SAME

(71) Applicant: WUXI LITTLE SWAN CO., LTD., Jiangsu (CN)

(72) Inventors: Lidong Wang, Jiangsu (CN); Yong Ban, Jiangsu (CN); Gaofeng Su, Jiangsu (CN)

(73) Assignee: Wuxi Little Swan Co., Ltd., Jiangsu (CN)

( * ) Notice: Subject to any disclaimer, the term of this patent is extended or adjusted under 35 U.S.C. 154(b) by 0 days.

(21) Appl. No.: 14/387,137

(22) PCT Filed: Nov. 8, 2012

(86) PCT No.: PCT/CN2012/084288

§ 371 (c)(1),
(2) Date: Sep. 22, 2014

(87) PCT Pub. No.: WO2013/139130

PCT Pub. Date: Sep. 26, 2013

(65) Prior Publication Data

US 2015/0048109 A1 Feb. 19, 2015

(30) Foreign Application Priority Data

Mar. 22, 2012 (CN) ..... 2012 1 0077617

(51) Int. Cl.
*D06F 39/02* (2006.01)
*D06F 33/02* (2006.01)
(Continued)

(52) U.S. Cl.
CPC ..... *D06F 39/02* (2013.01); *D06F 33/02* (2013.01); *D06F 39/022* (2013.01);
(Continued)

(58) Field of Classification Search
CPC ..... B67D 1/1231; D06F 39/02; D06F 39/022; D06F 39/085; D06F 33/02; F04B 1/005; F04B 9/02
(Continued)

(56) References Cited

U.S. PATENT DOCUMENTS 3,089,618 A * 5/1963 Forsyth ..... G01F 11/021 222/60
4,045,343 A * 8/1977 Achener ..... F04B 49/20 210/101
(Continued)

FOREIGN PATENT DOCUMENTS

CN 201221027 Y 4/2009
CN 102587090 A 7/2012
(Continued)

OTHER PUBLICATIONS

PCT/CN2012/084288 English Translation of the International Search Report mailed Feb. 28, 2013, 2 pages.

*Primary Examiner* — Charles P Cheyney
(74) *Attorney, Agent, or Firm* — Lathrop Gage LLP

(57) ABSTRACT

A delivery device for delivering a detergent independently of a change in a viscidity of a detergent and a method of controlling the same are provided. The delivery device includes a detergent storage; a pump configured to inject the detergent into a dissolving container a motor configured to drive the pump; a delivery container communicated with the detergent storage via a first one-way valve; the dissolving container communicated with the delivery container via a second one-way valve, the first and second one-way valves having opposite liquid conducting directions; a piston disposed in the delivery container; a crank-connecting rod mechanism constituted by the delivery container, the piston, a piston rod and a crankshaft; a contact switch; a cam disposed on a main journal of the crankshaft, a point of an outer contour of the cam triggering the contact switch to turn on and off once when the crankshaft makes one revolution.

4 Claims, 1 Drawing Sheet

(51) Int. Cl.

| | |
|---|---|
| ***D06F 39/08*** | (2006.01) |
| ***F04B 1/00*** | (2006.01) |
| ***F04B 53/00*** | (2006.01) |
| ***F04B 9/02*** | (2006.01) |
| ***F04B 13/00*** | (2006.01) |
| ***F04B 23/06*** | (2006.01) |
| ***F04B 49/06*** | (2006.01) |
| ***F04B 49/10*** | (2006.01) |
| *D06F 58/28* | (2006.01) |

(52) U.S. Cl.
CPC ..... *D06F 39/085* (2013.01); *F04B 1/005* (2013.01); *F04B 9/02* (2013.01); *F04B 13/00* (2013.01); *F04B 23/06* (2013.01); *F04B 49/06* (2013.01); *F04B 49/065* (2013.01); *F04B 49/106* (2013.01); *F04B 53/006* (2013.01); *D06F 2058/2896* (2013.01); *F04B 2205/09* (2013.01); *F04B 2205/14* (2013.01)

(58) Field of Classification Search
USPC .... 222/63, 333, 386, 309, 319, 23; 68/17 R; 417/415, 416
See application file for complete search history.

(56) References Cited

U.S. PATENT DOCUMENTS 4,352,636 A * 10/1982 Patterson ..... F04B 49/20 417/22
4,422,831 A * 12/1983 Schmid ..... F04B 53/06 417/440
4,656,376 A * 4/1987 Hyldal ..... H02K 29/06 310/20
4,681,513 A * 7/1987 Saito ..... F04B 1/02 417/18
4,820,129 A * 4/1989 Magnussen, Jr. ... F04B 11/0041 210/101
5,088,902 A * 2/1992 Marioni ..... F04B 9/02 137/512.4
5,344,047 A * 9/1994 Chen ..... A47K 5/1217 222/333
5,507,413 A * 4/1996 Chen ..... A47K 5/1217 222/181.2
6,344,723 B1 * 2/2002 Oh ..... G05B 19/06 318/3
6,913,447 B2 * 7/2005 Fox ..... F04B 1/20 222/283
2004/0151594 A1 * 8/2004 Allington ..... F04B 1/02 417/12
2006/0120898 A1 * 6/2006 Zeh ..... F04B 49/02 417/416
2008/0031747 A1 * 2/2008 Eijkelkamp ..... F04B 39/0055 417/321
2012/0006077 A1 * 1/2012 Mun ..... D06F 9/003 68/17 R
2013/0240570 A1 * 9/2013 Johansson ..... F04B 17/044 222/333

FOREIGN PATENT DOCUMENTS

| | | |
|---|---|---|
| CN | 102704241 A | 10/2012 |
| CN | 202543648 U | 11/2012 |
| GB | 530515 | 12/1940 |

* cited by examiner

DOSING DEVICE OVERCOMING CHANGE IN VISCIDITY OF DETERGENT AND METHOD FOR CONTROLLING SAME

CROSS-REFERENCE TO RELATED APPLICATION

This U.S. application claims priority under 35 U.S.C 371 to, and is a U.S. National Phase application of, the International Patent Application No. PCT/CN2012/084288, filed Nov. 8, 2012, which claims the benefit of prior Chinese Application No. 201210077617.4 filed Mar. 22, 2012. The entire contents of the above-mentioned patent applications are incorporated by reference as part of the disclosure of this U.S. application.

FIELD

The present invention relates to a component of a washing device and a method for using the same, and more particularly to a detergent delivery device of a washing machine and a method for controlling the same.

BACKGROUND

The washing machine in the related art has the function of adding a detergent automatically. Specifically, a container for storing the detergent is mounted in the interior of the washing machine, and when the washing machine operates, a certain quantity of detergent is sucked into a washing tub by means of a pump according to weight information of the clothes detected by means of the automatic weighting function of the washing machine, so as to achieve the smart adding of the detergent. However, the detergent exhibits different viscidities at different temperatures. The detergent adding method of an automatic delivery device in the related art mainly includes calculating a normal sucking rate at a normal temperature by means of a controller to calculate the motor running time of the detergent pump, and controlling a motor to run by means of the motor running time. However, when the detergent with different viscidities is added, since the sucking rates of the pump are different and the controller calculates the motor running time using a unified standard, the amount of the detergent added differs largely. Even if the environmental temperature is determined and fed back to the controller to adjust the delivery time, it is possible to only achieve the precise delivery of one type of detergent under a certain brand, but the delivery of detergents under other brands is inaccurate since the detergents under other brands exhibit different viscidity change rules at different temperatures.

SUMMARY

Embodiments of the present invention seek to solve at least one of the problems existing in the related art to at least some extent. Accordingly, the present invention provides a new detergent adding device and a method for controlling the same, with which the delivery amount of a detergent is controlled independently of time, and the precise delivery of different detergents may be realized even if the different detergents have different viscidities at different temperatures. The particular technical solutions are provided as follows:

A delivery device for delivering a detergent independently of a change in a viscidity of a detergent includes a detergent storage, a pump configured to draw the detergent from the detergent storage and inject the detergent into a dissolving container, a motor configured to drive the pump, a delivery container communicated with the detergent storage via a first one-way valve, and the dissolving container communicated with the delivery container via a second one-way valve, wherein the first and second one-way valves are mounted at a top of the delivery container and have opposite liquid conducting directions, a piston is disposed in the delivery container, a crank-connecting rod mechanism connected with the motor is constituted by the delivery container, the piston, a piston rod and a crankshaft, a cam is disposed on a main journal of the crankshaft, and a point of an outer contour of the cam which is farthest from a center of a base circle of the cam is adapted to contact with a contact switch, and the point triggers the contact switch to turn on and off once when the crankshaft makes one revolution, and the contact switch is connected with a controller of a washing machine.

A method of controlling a delivery device for delivering a detergent independently of a change in a viscidity of a detergent includes steps of:

step 1, calculating by a controller a volume V of a detergent to be added according to the weight, materials, and dirt level of the clothes, a temperature, and other factors;

step 2, calculating by the controller a number n of cycles of a doser according to the volume V of the detergent to be added and a volume vo added by a delivery container in one cycle, where n=V/vo;

step 3, counting by the controller a revolution of a motor, and instructing by the controller the motor to stop rotation when the revolution of the motor reaches n; and step 4, delivering the detergent into a dissolving container, and flushing the detergent into a washing tub by water to participate in washing.

Since the drawing rates of the pump are different under different viscidities and the motor rotates slowly when the viscidity is high, it will take a long time to add adequate detergent. If the technique in the related art is used to control the motor to start only according to time, the detergent added may be inadequate. According to an embodiment of the present invention, by controlling the motor by means of the revolution of the motor, the amount of the detergent added may be precisely controlled, and the control on the amount of the detergent added will not be influenced due to the change in the viscidity of the detergent.

DETAILED DESCRIPTION

Figure 1:
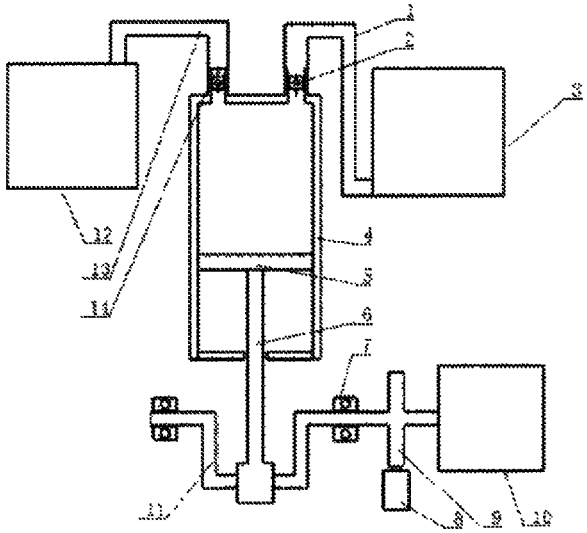
FIG. 1 is a schematic view of a delivery device for delivering a detergent independently of a change in a viscidity of a detergent according to an embodiment of the present invention.
Figure 2:
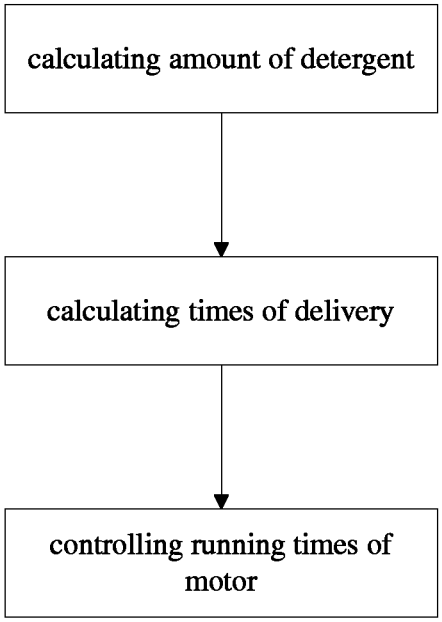
FIG. 2 is a flow chart of a method of controlling a delivery device for delivering a detergent independently of a change in a viscidity of a detergent according to an embodiment of the present invention.

Reference will be made in detail to embodiments of the present invention with reference to drawings. As shown in FIG. 1, a delivery device for delivering a detergent independently of a change in a viscidity of a detergent includes a detergent storage 3, a pump configured to draw the detergent from the detergent storage 3 and inject the detergent into a dissolving container 12, a motor 10 configured to drive the pump, a delivery container 4 communicated with the detergent storage 3 via a one-way valve 2 and a conduit 1, and the dissolving container 12 communicated with the delivery container 4 via a one-way valve 14 and a conduit 13. The one-way valves 2, 14 are mounted at a top of the delivery container 4 and have opposite liquid conducting directions. A piston 5 is disposed in the delivery container 4. A crank-connecting rod mechanism connected with the motor 10 is constituted by the delivery container 4, the piston 5, a piston rod 6, and a crankshaft 11 supported by a bearing 7. A cam 9 is disposed on a main journal of the crankshaft 11, and a point of an outer contour of the cam 9 which is farthest from a center of a base circle of the cam is adapted to contact with a contact switch 8, and the point triggers the contact switch to turn on and off once when the crankshaft makes one revolution. The contact switch 8 is connected with a controller of a washing machine.

A method of controlling a delivery device for delivering a detergent independently of a change in a viscidity of a detergent includes the following steps.

At step 1, a controller calculates a volume V of a detergent to be added according to the weight, materials, and dirt level of the clothes, a temperature, and other factors.

At step 2, the controller calculates a number n of cycles of a doser according to the volume V of the detergent to be added and a volume vo added by the delivery container 4 in one cycle, where n=V/vo.

At step 3, the contact switch 8 counts a revolution of the cam 9. When the revolution of the cam 9 reaches n, the controller instructs the motor to stop rotation.

At step 4, the detergent is delivered into a dissolving container, and flushed into a washing tub by water to participate in the washing.

What is claimed is:

1. A delivery device for delivering a detergent independently of a change in a viscidity of a detergent, which delivery device comprising:

a detergent storage;

a pump configured to draw the detergent from the detergent storage and inject the detergent into a dissolving container;

a motor configured to drive the pump;

a delivery container communicated with the detergent storage via a first one-way valve;

the dissolving container communicated with the delivery container via a second one-way valve, the first and second one-way valves being mounted at a top of the delivery container and having opposite liquid conducting directions;

a piston disposed in the delivery container;

a crank-connecting rod mechanism connected with the motor and constituted by the delivery container, the piston, a piston rod and a crankshaft, the crankshaft including a main journal directly coupled to a secondary journal offset from the main journal, the piston rod being coupled to the secondary journal, the main journal and the secondary journal forming a recess such that when the piston is located nearest the main journal as the crankshaft rotates, the piston rod is located in the recess;

a contact switch connected with a controller of a washing machine;

a cam disposed on the main journal of the crankshaft, a point of an outer contour of the cam, which is farthest from a center of a base circle of the cam, being configured to contact the contact switch, and, in response to said contact, trigger the contact switch to turn on and off once when the crankshaft makes one revolution.

2. A method of controlling a delivery device for delivering a detergent independently of a change in a viscidity of a detergent, comprising steps of:

step 1, calculating by a controller a volume V of a detergent to be added;

step 2, calculating by the controller a number n of cycles of a doser according to the volume V of the detergent to be added and a volume vo added by a delivery container in one cycle, where n=V/vo;

step 3, counting by the controller a revolution of a motor based upon a point contacting a contact switch, and in response to the contacting, triggering the contact switch to turn on and off, the point being an outer contour of a cam disposed on a main journal of a crankshaft of the doser, the crankshaft including a secondary journal directly coupled and offset to the main journal having a piston rod coupled thereto for controlling a piston of the doser, the main journal and the secondary journal forming a recess such that when the piston is located nearest the main journal as the crankshaft rotates, the piston rod is located in the recess, and instructing by the controller the motor to stop rotation when the revolution of the motor reaches n; and step 4, delivering the detergent into a dissolving container, and flushing the detergent into a washing tub by water to participate in washing.

3. The delivery device of claim 1, the main journal being supported by a bearing.

4. The delivery device of claim 3, the main journal being supported by a second bearing, the secondary journal located between the bearing and second bearing.

* * * * *